United States Patent [19]

Graves

[11] Patent Number: 4,740,931

[45] Date of Patent: Apr. 26, 1988

[54] SOLAR SYSTEM CLOCK

[76] Inventor: Joseph R. Graves, 2132 Second Ave., Apt. 505, Seattle, Wash. 98121

[21] Appl. No.: 95,914

[22] Filed: Sep. 14, 1987

[51] Int. Cl.[4] ..... G04B 19/26

[52] U.S. Cl. ..... 368/17

[58] Field of Search ..... 368/15, 20

[56] References Cited

U.S. PATENT DOCUMENTS

| | | | |
|---|---|---|---|
| 4,583,864 | 4/1986 | Graves | 368/17 |
| 4,671,669 | 6/1987 | Graves | 368/17 |
| 4,684,260 | 8/1987 | Jackle | 368/16 |

*Primary Examiner*—Vit W. Miska

*Attorney, Agent, or Firm*—Norman B. Rainer

[57] ABSTRACT

A clock is provided having a visual effect mechanism associated with the shaft of the clock that would ordinarily drive the second hand. The visual effect produced is that of the earth rotating about a central sun every sixty seconds while clouds drift past the apparently stationary land masses of earth. The mechanism utilizes a depiction of the earth attached by a holding bolt or post to a second hand or equivalent structure, and a transparent overlay disposed over the depiction of earth and pivotably supported by the holding bolt or post.

8 Claims, 2 Drawing Sheets

SOLAR SYSTEM CLOCK

BACKGROUND OF THE INVENTION

This invention relates to a clock, and more particularly concerns a clock whose face is provided with a centered representation of the sun and a depiction of earth rotatively driven about the sun by the mechanism of the clock that indicates seconds of time.

Conventional techniques for displaying time are well known to all and include numerical displays, rotating hands, and the like. Clocks which further provide moving displays for educational purposes or visual attractiveness are also well known. The depiction of aspects of the solar system on clock faces has been disclosed, but such clocks are either of complex construction or involve minimal movement of the visually attractive components.

U.S. Pat. No. 4,583,864 discloses a clock wherein a spherical representation of the earth is caused to rotate about a stationary central depiction of the sun. During such rotation, the earth sphere also spins on its axis, thereby providing a realistic display of actual solar system motions. However, said display is activated by two gears which necessitate a costly precision construction.

It is accordingly an object of the present invention to provide a clock which realistically depicts movement of the earth around the sun.

It is a further object of this invention to provide a clock as in the foregoing object wherein depictions of clouds and the moon are shown in movement with respect to a depiction of earth.

It is a still further object of this present invention to provide a clock of the aforesaid nature amenable to economical manufacture by way of simple modification of clocks of conventional design. These objects and other objects and advantages of the invention will be apparent from the following description.

SUMMARY OF THE INVENTION

The above and other beneficial objects and advantages are accomplished in accordance with the present invention by a clock comprising:

(a) a timing mechanism, (b) a generally flat circular face having hour-indicating indicia, (c) coaxial drive shafts centrally positioned in said face and rotated by said timing mechanism to accommodate hour, minute and second hands, (d) a flat opaque representation of the sun centered upon said drive shafts in perpendicular relationship thereto and forwardly spaced from said circular face, and (e) a visual effect mechanism comprising:

(1) extension means in parallel disposition to said face and having a proximal extremity coupled to the drive shaft for said second hand and a distal extremity radially removed from said drive shaft, (2) a representation of earth attached in fixed relationship to said extension means at a site located radially between the perimeter of the sun and the hour-indicating indicia, and (3) a transparent overlay having a perimeter circularly disposed about a center axis, said overlay bearing a depiction of clouds, and being pivotably associated with said earth in a manner which maintains said perimeter in fixed orientation with respect to its center axis while the earth rotates about the sun, whereby (f) an illusion is presented of the clouds moving across the earth as the earth rotates about the sun.

In a preferred embodiment of the invention, the clock has a transparent cover forwardly spaced from said face, the representation of the sun being centrally affixed to said cover. The extension means is preferably a transparent circular disc centered upon the drive shaft for the second hand. The overlay may have a depiction of the moon in addition to the clouds. The shape of the representations of earth and the associated overlay may be flat, hemi-spherical, or spherical. The representation of earth is preferably affixed to the extension means by a bolt perpendicular thereto and disposing the earth between the extension means and the interior surface of the transparent cover. The face of the clock may have depictions of planets of the solar system.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
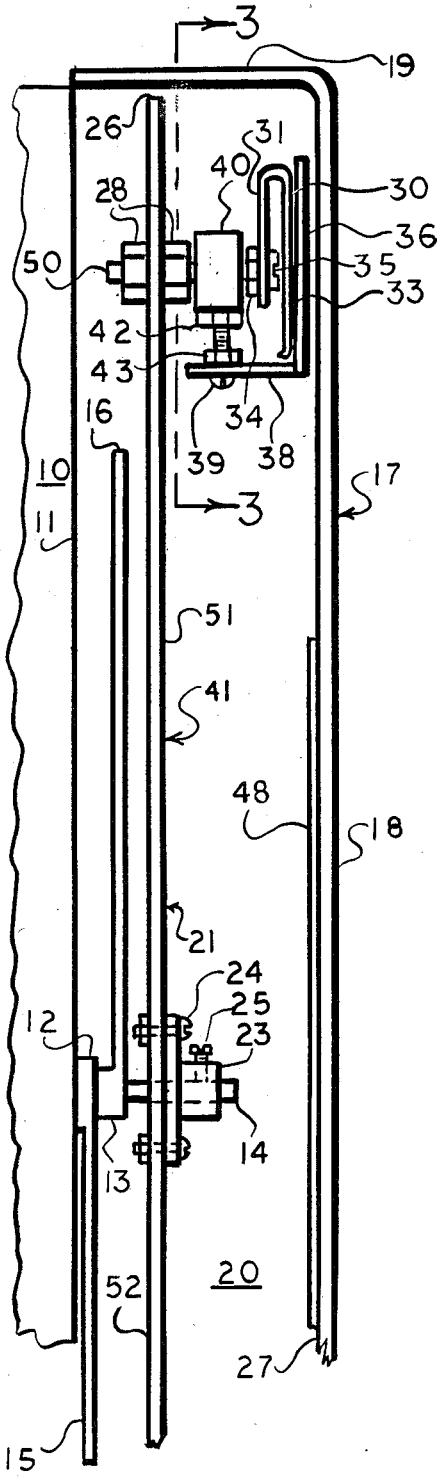
FIG. 1 is a fragmentary side view of an embodiment of the clock of the present invention.

For convenience in description, the terms "interior" or words of similar import will have reference to the interior of the region bounded by the clock face and cover as shown in FIG. 1. The expressions "forward" and "rearward" and equivalents thereof will have reference to locations adjacent the cover and face, respectively.

DESCRIPTION OF THE PREFERRED EMBODIMENT

Figure 3:
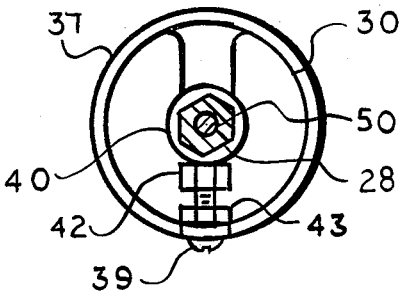
FIG. 3 is a sectional rear view taken on the line 3—3 of FIG. 1.
Figure 2:
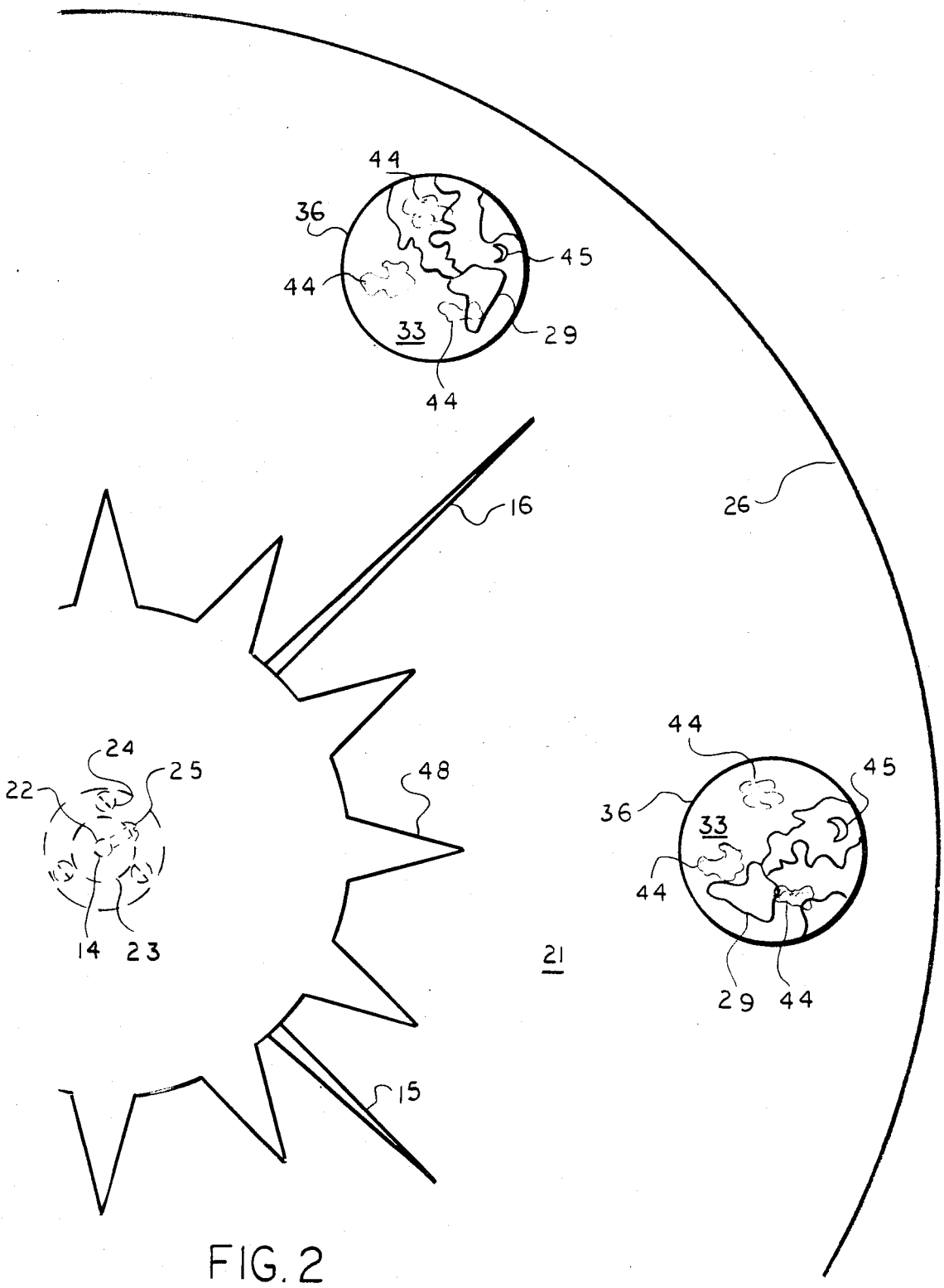
FIG. 2 is a fragmentary front view thereof showing the visual effect mechanism in two different positions.

Referring to FIGS. 1–3, an embodiment of the clock of the present invention is shown comprised of housing 10 which encloses a timing mechanism of conventional design driven preferably by an electrical motor, a time-indicating flat face 11 of circular perimeter forwardly enclosing said timing mechanism, and concentric drive shafts 12, 13 and 14 extending from the timing mechanism through the center of said face and adapted to drive the hour, minute and second hands, respectively. Second hand drive shaft 14 is elongated beyond the usual length of such drive shaft of conventional clocks. Hour hand 15 and minute hand 16 are attached to their respective drive shafts.

A transparent integral cover 17 comprised of flat forward panel 18 and encircling sidewall 19 is affixed to the clock in front of face 11, forming a protective enclosure 20. An opaque flat representation of the sun 48 having a substantially circular perimeter is centrally affixed to the interior surface 27 of panel 18.

A visual effect mechanism 41 is associated with second hand drive shaft 14 and disposed within enclosure 20. Said mechanism 41 is comprised in part of extension means in the form of a vertically oriented flat circular disc 21 of transparent plastic material having forward and rearward surfaces 51 and 52, respectively, and centered aperture 22. Disc 21 is perpendicularly attached to drive shaft 14 by means of collar-flange fitting 23 which engages disc 21 by means of bolts 24, and engages shaft 14 by means of lock screw 25. The centered aperture 22, by means of which disc 21 is attached to shaft 14, is considered the proximal extremity of said disc embodiment of extension means. The circular periphery 26 of disc 21 is considered its distal extremity. In alternate embodiments, the extension means may have the form of a substantially conventional elongated indicating hand directed radially away from shaft 14. The advantage of the disc embodiment of extension means is that it is a substantially invisible support for the other components of the visual effect mechanism. In embodiments of the clock not equipped with a transparent cover, the representation of the sun may be centered upon the transparent disc. In still other embodiments, the sun may be a plate perpendicularly affixed to the shaft for the second hand.

Horizontally disposed extension bolt 50 is perpendicularly affixed to disc 21 at a site radially inward from the hour-indicating indicia on the face of the clock. Positioning nuts 28 adjust the distance that bolt 50 extends forwardly from the forward surface 51 of disc 21. An embodiment of a representation of earth is fabricated from a single piece of flat metal stock by a cutting and bending operation which produces a flat plate 30 of circular perimeter, and a rearwardly disposed mounting tab 31 having an aperture that accommodates bolt 50. The forward face 33 of plate 30 contains a depiction of the land masses 29 of earth. A retainer nut 34 holds tab 31 tightly against the head 35 of bolt 50.

A transparent overlay 36 of flat plastic having a circular perimeter 37 of substantially the same size as the perimeter of plate 30, is disposed over the forward face of said plate in closely spaced parallel juxtaposition therewith. Overlay 36 is supported in proper position by an assembly comprising elongated baseplate 38 perpendicularly attached to the perimeter of the overlay at the lower extremity thereof, and attached by vertical bolt 39 to collar 40 loosely supported by horizontal bolt 50. Lock nuts 42 and 43 stabilize the distance between collar 40 and baseplate 38. The overlay 36 contains depictions of clouds 44 and the moon 45. Collar 40 has a sufficient length to abut lightly against retainer nut 34 and positioning nut 28 on bolt 50, thereby preventing lateral movement of the overlay assembly while not impairing the free rotation of collar 40 about bolt 50.

Because of the aforesaid interaction of component parts, when the representation of earth rotates as would a second hand of a clock, it remains in fixed orientation with respect to the center of disc 21. However, overlay 36 pivots freely about horizontally disposed bolt 50 so as to have constant vertical and horizontal axes despite its location upon the face of the clock. As shown in FIG. 2, such interaction between earth and the overlay produce the appearance of clouds and the moon floating around the earth. In view of the aforesaid interaction of the several components of the clock, it is important to note that the site of attachment of bolt 50 to disc 21 is such that the representation of earth will not obscure the hour indicating indicia on the face of the clock.

Figure 4:
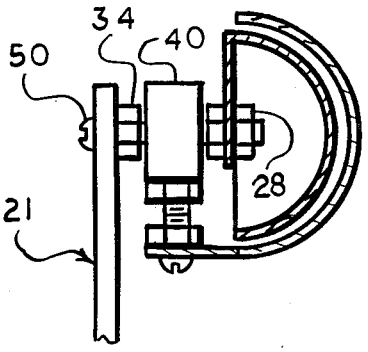
FIG. 4 is a fragmentary side view, partly in section, of a first alternative embodiment of the clock of the present invention.

In the first alternative embodiment, shown in FIG. 4, the representation of earth and the corresponding overlay are of hemispherical contour instead of being flat. However, structural components similar to those of the embodiment of FIGS. 1–3 produce the same ultimate result.

Figure 5:
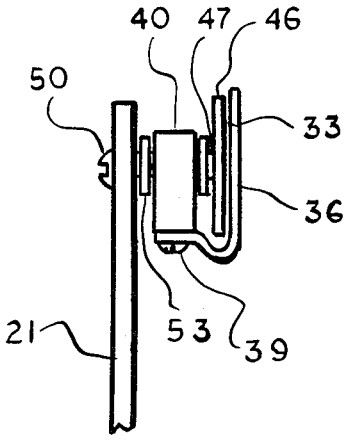
FIG. 5 is a fragmentary side view of a second alternative embodiment of the clock of this invention.

In the second alternative embodiment, shown in FIG. 5, the representation of earth, instead of being fabricated from a single piece of sheet metal by a bending operation, is fabricated from a flat face piece 46, and a centered cylindrical spindle 47 which fits upon bolt 50. Spacing washers 53 may be disposed upon spindle 47. The ultimate effect is, however, substantially the same as in the embodiment exemplified in FIGS. 1–3.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A clock depicting features of the solar system comprising:

(a) a timing mechanism, (b) a generally flat circular face having hour-indicating indicia, (c) coaxial drive shafts centrally positioned in said face and rotated by said timing mechanism to accommodate hour, minute and second hands, (d) a flat opaque representation of the sun centered upon said drive shafts in perpendicular relationship thereto and forwardly spaced from said face, and (e) a visual effect mechanism comprising:

(1) extension means in parallel disposition to said face and having a proximal extremity coupled to the drive shaft for said second hand and a distal extremity radially removed from said drive shaft, (2) a representation of earth attached in fixed relationship to said extension means at a site located radially between the perimeter of the sun and the hour-indicating indicia, and (3) a transparent overlay having a perimeter circularly disposed about a center axis, said overlay bearing a depiction of clouds, and being pivotably associated with said earth in a manner which maintains said perimeter in fixed orientation with respect to its center axis while the earth rotates about the sun, whereby (f) an illusion is presented of the clouds moving across the earth as the earth rotates about the sun.

2. The clock of claim 1 wherein said extension means is a flat circular transparent disc.

3. The clock of claim 1 wherein said representation of earth and said transparent overlay are flat.

4. The clock of claim 1 wherein said representation of earth and said transparent overlay are hemispherical.

5. The clock of claim 2 wherein said representation of earth is attached to said disc by a bolt extending perpendicularly from said disc in the direction away from said face.

6. The clock of claim 5 wherein said transparent overlay is pivotably associated with said earth by means pendantly supported by and freely rotatable about said bolt.

7. The clock of claim 1 wherein said representation of earth is attached to said extension means at a site radially inward from the hour-indicating indicia of the face.

8. The clock of claim 1 wherein the clock has a transparent cover forwardly spaced from said face, and the representation of the sun is centrally affixed to said cover.

* * * * *